United States Patent [19]

Lacks

[11] 3,999,937

[45] Dec. 28, 1976

[54] REMOVABLE LIGHTER CASING

[76] Inventor: Harold G. Lacks, 2100 S. Ocean Lane, Apt. 2407, Fort Lauderdale, Fla. 35394

[22] Filed: Dec. 8, 1975

[21] Appl. No.: 638,702

[52] U.S. Cl. ..... 431/344; 431/144

[51] Int. Cl.[2] ..... F23Y 2/50

[58] Field of Search ..... 431/144, 146, 152, 344, 431/253

[56] References Cited

UNITED STATES PATENTS

| | | | |
|---|---|---|---|
| 2,352,897 | 7/1944 | Hickman | 431/144 |
| 2,774,234 | 12/1956 | Blaisdell et al. | 431/152 |
| 2,803,123 | 8/1957 | Owen | 431/344 |
| 3,744,958 | 7/1973 | Cobarg | 431/344 X |

*Primary Examiner*—Edward G. Favors
*Attorney, Agent, or Firm*—Malin & Haley

[57] ABSTRACT

A lighter casing for a lighter having two end portions larger than a narrower central portion. The lighter casing including a main member, and a secondary member connected inside said main member by a hinge means positioned nearer the base end of the lighter casing. The main member and the secondary member in a closed position leave two longitudinal step ridges along the lighter casing. The lighter casing also includes a cover member having its top end movably connected to the top end of the secondary member and having its lower end movably connected to the lower end portion of the main member by connecting means in order to fill the two step ridges when the lighter casing is in a closed position.

2 Claims, 10 Drawing Figures

REMOVABLE LIGHTER CASING

BACKGROUND OF THE INVENTION

In the past lighters have had cylindrical or rectangular shaped bodies. The replaceable covers for permanent lighters or permanent covers for throw-away lighters have been constructed of the identical shape as the body of the lighter.

BRIEF DESCRIPTION OF THE INVENTION

A lighter casing for a lighter having two end portions larger than a narrower central portion. The lighter casing including a main member, a secondary member connected inside said main member and a cover member. The main member and the secondary member are connected by overlapping the main member over the second member. Hinge means are positioned nearer the base end of the lighter casing to provide a hinged connection. The main member and the secondary member in a closed position leave two longitudinal step ridges along the lighter casing. The cover member fills the ridges. The top end of the cover member is movably connected to the top end of the secondary member and the lower end of the cover member is connected to the lower end portion of the main member by connecting means in order to fill the two step ridges when the lighter casing is in a closed position.

It is an object of the invention to provide a lighter casing having an automatic scissor-like action to provide an outer cylindrical casing surface.

It is another object of this invention to provide a non-complex cover member for a two member lighter casing having a scissor-like action, with the cover member connected to the top of one of the lighter casing members and to the bottom of the other lighter casing member.

Another object of this invention is to provide a lighter casing with a cover member that opens with scissor-like action, opening the top and narrowing the base for a lighter having two enlarged ends and a smaller intermediate portion that automatically closes the top of the lighter casing as it widens the base of the lighter casing when the lighter is slid into the top lighter casing and moved past the hinge members.

In accordance with these and other objects which will be apparent hereinafter, the instant invention will now be described with particular reference to the accompanying drawing.

DESCRIPTION OF AN EMBODIMENT OF THE INVENTION

Figure 1:
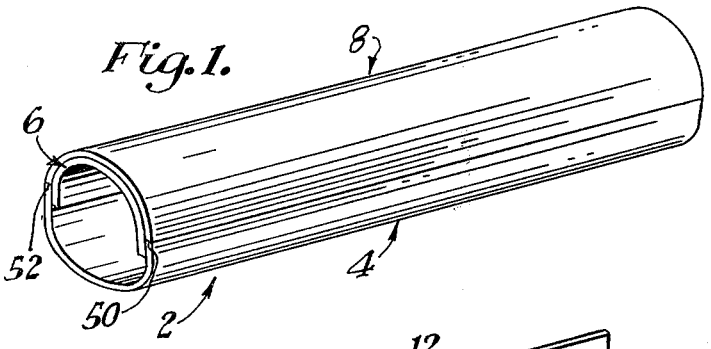
FIG. 1 is an isometric view of the removable lighter casing in a closed position.
Figure 5:
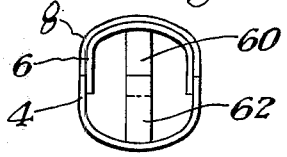
FIG. 5 is a top end view of the lighter casing shown in FIG. 1.
Figure 2:
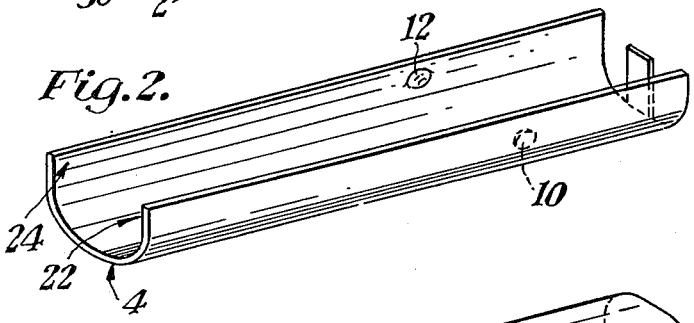
FIG. 2 is an isometric view of the main member, shown in FIG. 1.
Figure 6:
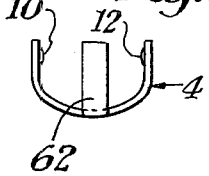
FIG. 6 is a base end view of the main member shown in FIG. 2.
Figure 3:
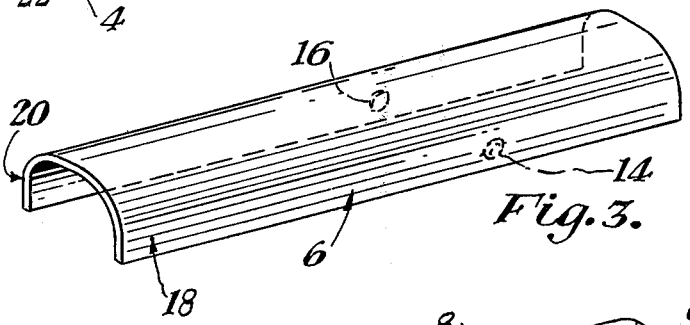
FIG. 3 is an isometric view of the secondary member shown in FIG. 1.
Figure 7:
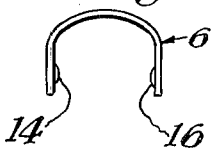
FIG. 7 is a base end view of the secondary member shown in FIG. 3.
Figure 8:
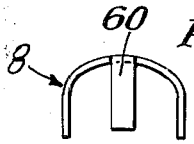
FIG. 8 is a base end view of the cover member shown in FIG. 4.
Figure 4:
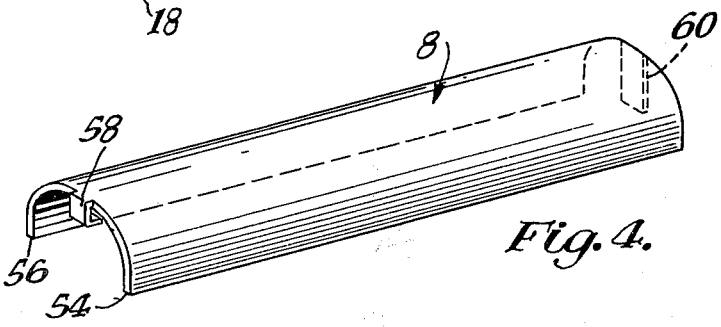
FIG. 4 is an isometric view of the cover member shown in FIG. 1.
Figure 9:
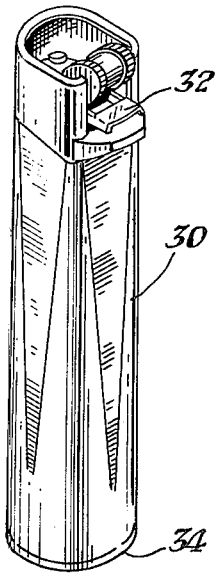
FIG. 9 is an isometric side view of a lighter that the removable lighter casing will fit.

Referring now to a new and improved replaceable lighter casing shown in FIGS. 1 through 8 and 10 for a lighter with a smaller perimeter intermediate portion 30 spaced from larger end portions 32 and 34 shown in FIG. 9, the removable lighter casing 2 includes a scissor body means. The scissor body means includes a main member 4 also shown in FIGS. 1, 2 and 6 and a secondary member 6 shown in FIGS. 1, 3 and 7. The main member 4 and the secondary member 6 are connected together by mating of the indented hinge portions 10 and 12 of the main member 4 to the hinge portions 14 and 16 of the secondary member 4. A portion of the distal longitudinal outside edge portion 18 and 20 of the secondary member 6 as shown in FIG. 3, engages the distal longitudinal inside edge portions 22 and 24 of the main member 4 as shown in FIG. 2 when the lighter casing 4 is in a closed position, see FIGS. 1 and 5.

Figure 10:
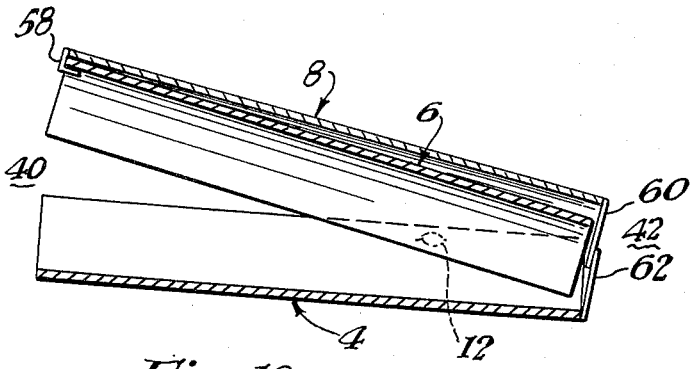
FIG. 10 is a cross section side view of the removable lighter casing in an open position.

The removable lighter case shown in FIG. 1 for a lighter as shown in FIG. 9 includes a main member 4 and a secondary member 6 connected to said main casing member by hinge means 10, 12, 14 and 16 positioned approximately one-third plus or minus one-sixth, of the total longitudinal length of the lighter casing from the base end of the lighter cover, that is, from the right end of the lighter casing as shown in FIG. 1. To place the cover on the lighter, the top end, the left side of FIG. 1, of the lighter cover is opened as shown in FIG. 10 and the bottom end is narrowed by scissor-like movement of the members about the hinge means. After the base 34 of lighter is inserted into said top end as shown in FIG. 10 and moved past the hinge means, the sides of the members adjacent the enlarged end adjacent numeral 40 are moved closer together about the lighter as the sides of the members adjacent the base end adjacent numeral 42 are moved further apart by engagement with the base 34 as the lighter moves from left to right when viewing FIG. 10. When the lighter shown in FIG. 9 is fully inserted into the lighter casing, the lighter casing encloses the lighter except for the enlarged end 32.

The cover member 8 is used to fill the step-like portion adjacent the longitudinal edges of the main member shown by numerals 50 and 52 in FIG. 1. The cover member includes longitudinal edges 54 and 56 that are placed in juxta position with the longitudinal edges of the main member 4 when the casing is closed. The top end of the cover member 8 includes a connecting means shown as a clip member 58 that engages the top edge of the secondary member 6. A connecting means shown as a base member 60 is connected to the base end of the cover member 8. The main member 4 may include a second base member 62. The distal ends of base members 60 and 62 may be connected by welding or crimping or any other well known means of connecting two members.

As shown in FIG. 10, the cover member 8 is movably connected to the secondary member for independent relative movement. These connections are positioned apart from the hinge means 10, 12, 14, and 16 to allow the cover member to be moved when the secondary member is moved and to allow the cover member to assume the position shown in FIG. 1 in the closed position. The cover member allows the casing as shown in FIG. 1 to form a generally cylindrical outer surface, thereby the step-like portion is covered.

The lighter casing may be made of metal or other suitable material.

In the closed position of the lighter cover or casing, the opening at the top end of said lighter casing is smaller than the opening in the lighter cover at the hinge means and smaller than the base of the lighter to lock the lighter in the lighter casing. The opening at the base end of said lighter cover is at least equal to the size of the base end of the lighter and the opening of the lighter cover at the hinge means is at least equal to the size of the base end of the lighter.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A lighter casing for a lighter having two end portions larger than a narrower central portion comprising:

a main member having a first and second end including a first hinge means, a secondary member having a first and second end including a second hinge means connected to said main member by said first and second hinge means to allow said first end of said lighter casing to be enlarged when the second ends are narrowed in a scissor-like movement, and a cover member having a first and second end having said first end movably connected to said first end of the secondary member and having said second end movably connected to said second end of the main member to position the longitudinal sides of said cover member in juxta position with the longitudidnal side edges of said secondary member.

2. A lighter casing as set forth in claim 1 wherein;

said first and second hinge means are positioned a distance of one third, plus or minus one sixth of the total longitudinal length of said lighter casing from the second ends.

* * * * *